United States Patent [19]

Joelsson et al.

[11] Patent Number: 4,472,899

[45] Date of Patent: Sep. 25, 1984

[54] FIRE ARM MECHANISM FOR A MULTI-BARREL WEAPON WITH BARREL SELECTOR

[75] Inventors: Knut B. Joelsson; Per G. Sandersson; Melker H. E Lindh; Rolf L. I. Johansson; Stig G. E. Bernandersson, all of Varberg; Rune H. Flodman; Rune L. Flodman, both of Nora, all of Sweden

[73] Assignee: Caprinus Vapen Aktiebolag, Sweden; a part interest

[21] Appl. No.: 394,933

[22] PCT Filed: Oct. 28, 1981

[86] PCT No.: PCT/SE81/00317

§ 371 Date: Jun. 30, 1982

§ 102(e) Date: Jun. 30, 1982

[87] PCT Pub. No.: WO82/01586

PCT Pub. Date: May 13, 1982

[30] Foreign Application Priority Data

Nov. 6, 1980 [SE] Sweden ..... 8007813

[51] Int. Cl.[3] ..... F41C 19/00

[52] U.S. Cl. ..... 42/42 R

[58] Field of Search ..... 42/42 R

[56] References Cited

U.S. PATENT DOCUMENTS

| | | | |
|---|---|---|---|
| 3,131,499 | 5/1964 | Arsenault | 42/42 R |
| 3,283,436 | 11/1966 | Bills | 42/42 R |
| 3,421,243 | 1/1969 | Browning | 42/42 R |
| 3,444,640 | 5/1969 | Simmons | 42/42 R |
| 3,537,203 | 11/1970 | Weatherby et al. | 42/42 R |
| 3,757,446 | 9/1973 | Vesamaa | 42/42 R |
| 3,786,588 | 1/1974 | Soana | 42/42 R |
| 3,808,724 | 5/1974 | Linde | 42/42 R |
| 4,091,556 | 5/1978 | Katsenes | 42/42 R |

FOREIGN PATENT DOCUMENTS

| | | | |
|---|---|---|---|
| 2311402 | 4/1974 | Fed. Rep. of Germany | 42/42 R |

*Primary Examiner*—Charles T. Jordan
*Assistant Examiner*—Ted L. Parr
*Attorney, Agent, or Firm*—Ostrolenk, Faber, Gerb & Soffen

[57] ABSTRACT

A fire arm mechanism for a multi-barrel weapon has a barrel selector for selecting the firing sequence of the barrels on successive pulls of a trigger (34) common to the barrels. The firing movement (arrow 49) of the trigger is transmitted to the release catches (20, 21) of the different barrels by means of a firing push link (27) pivotally mounted on the trigger and spring-loaded in a direction towards the release catches (arrow 48). In order to shift the firing sequence, the pivot axis (32) of the firing push link (27) is displaced transversely of its longitudinal axis so as to be displaced with respect to the release catches (20, 21), such that the firing push link, depending on its angular position, will either first engage the release catch (21) remote from the pivot center (32) or first engage the release catch (20) close to the pivot center.

6 Claims, 11 Drawing Figures

FIRE ARM MECHANISM FOR A MULTI-BARREL WEAPON WITH BARREL SELECTOR

In multi-barrel weapons, it is desirable that the shooter should be able to select the firing sequence for the different barrels. In hunting rifles, therefore, each barrel usually has a separate trigger. On the other hand, use has also been made of devices in which the trigger is common to all the barrels and shifting of the firing sequence is carried out by means of a barrel selector included in the mechanism. Thus, U.S. Pat. No. 3,537,203 discloses a fire arm with internal hammers for a respective firing pin, the shifting of the firing sequence being produced by lateral pivotment of an inner catch which locks one hammer while the other is fired. Similar mechanisms are shown in U.S. Pat. Nos. 3,444,640, 3,421,243, and 3,757,446. U.S. Pat. No. 3,786,588 discloses a barrel selector in which a barrel selector arm is displaceable parallel to its pivot axis, to be set in either of two positions depending on which barrel should be fired first. In U.S. Pat. No. 3,283,436 it has also been suggested that barrel selection should be effected by pivoting a link between the trigger and a push rod to each release catch. U.S. Pat. No. 1,131,499 discloses another method in which a special firing pin catch is used to arrest one firing pin while the other is fired when the trigger is pulled. A similar line of thought is described in DE-OS No. 2,311,402 in which a safety catch can be set in three positions in order that a connecting lug on it should either escape a pivot arm connected to the trigger or engage the release catch of either of the barrels. In U.S. Pat. No. 3,808,274, it has further been suggested to pivot the link of the trigger such that it is caused to act on either of two hammer release means. Finally, it has been suggested in U.S. Pat. No. 4,091,556 to utilize a stepped trigger linkage which is laterally shiftable and the steps of which determine the firing sequence, and which is used for transmitting the movement of the trigger to the respective release catch.

The fire arm mechanisms described above have in common the disadvantage of being of a complicated design and difficult to adjust.

The present invention sets out from a mechanism of a slightly different type, viz. a mechanism in which the firing means of the barrels can be arrested in the cocked state by means of associated pivotally mounted release catches each having an engagement surface for engaging a corresponding pressure surface on a firing push link which is pivotal about a pivot axis and thereby pivotally connected to the pivotally mounted trigger of the mechanism and which is common to the different firing means and yieldingly biase for pivoting in a direction for engaging the different release catches for successively releasing their associated firing means upon consecutive pulls of the trigger. A fire arm mechanism of this type is disclosed in Swedish patent application No. 7908132-9, but the mechanism described therein is not adjustable and so the firing sequence always takes place first in the lower barrel and then in the upper barrel.

The object of the present invention is to overcome the drawbacks inherent in the above-indicated adjustable mechanisms and to make the last-mentioned prior-art fire arm mechanism adjustable.

Thus, the invention provides a fire arm mechanism for a multi-barrel weapon with a barrel selector for selecting the firing sequence of the barrels on successive pulls of a trigger common to the barrels. The firing movement of the trigger is transmitted to the different release catches of the barrels by means of a firing push link pivotally mounted on the trigger and spring-loaded in a direction towards the release catches. In order to shift the firing sequence, the pivot axis of the firing push link is displaced transversely of its longitudinal axis with respect to the release catches, such that the firing push link, depending on its angular position, will either first engage the distal release catch with respect to the pivot axis or first engage the proximal release catch with respect to the pivot axis.

Thus, the invention is characterised in that the pivot axis of the firing push link is displaceable transversely of its longitudinal axis with respect to the engagement surfaces of the different release catches for setting the firing push link and its pressure surfaces in different angular positions with respect to said engagement surfaces to determine the firing sequence for the different barrels. If the mechanism is intended for a double-barrel weapon, it is particularly advantageous if the pivot axis of the firing push link is displaceable between two positions which are on either side of a straight line between the engagement surfaces of the release catches.

In a particularly advantageous embodiment of the invention, the firing push link is pivotally connected to a slide which is so displaceable on the trigger that the distance between the pivot axes of the trigger and of the firing push link pivotally connected thereto is adjustable to permit selecting the firing sequence.

The invention will be described in greater detail hereinbelow with reference to the accompanying drawings showing an embodiment of a fire arm mechanism according to the present invention.

FIGS. 8–11 similarly show the positions of the mechanism in the firing sequence over barrel - under barrel.

Figures 1, 2, 3:
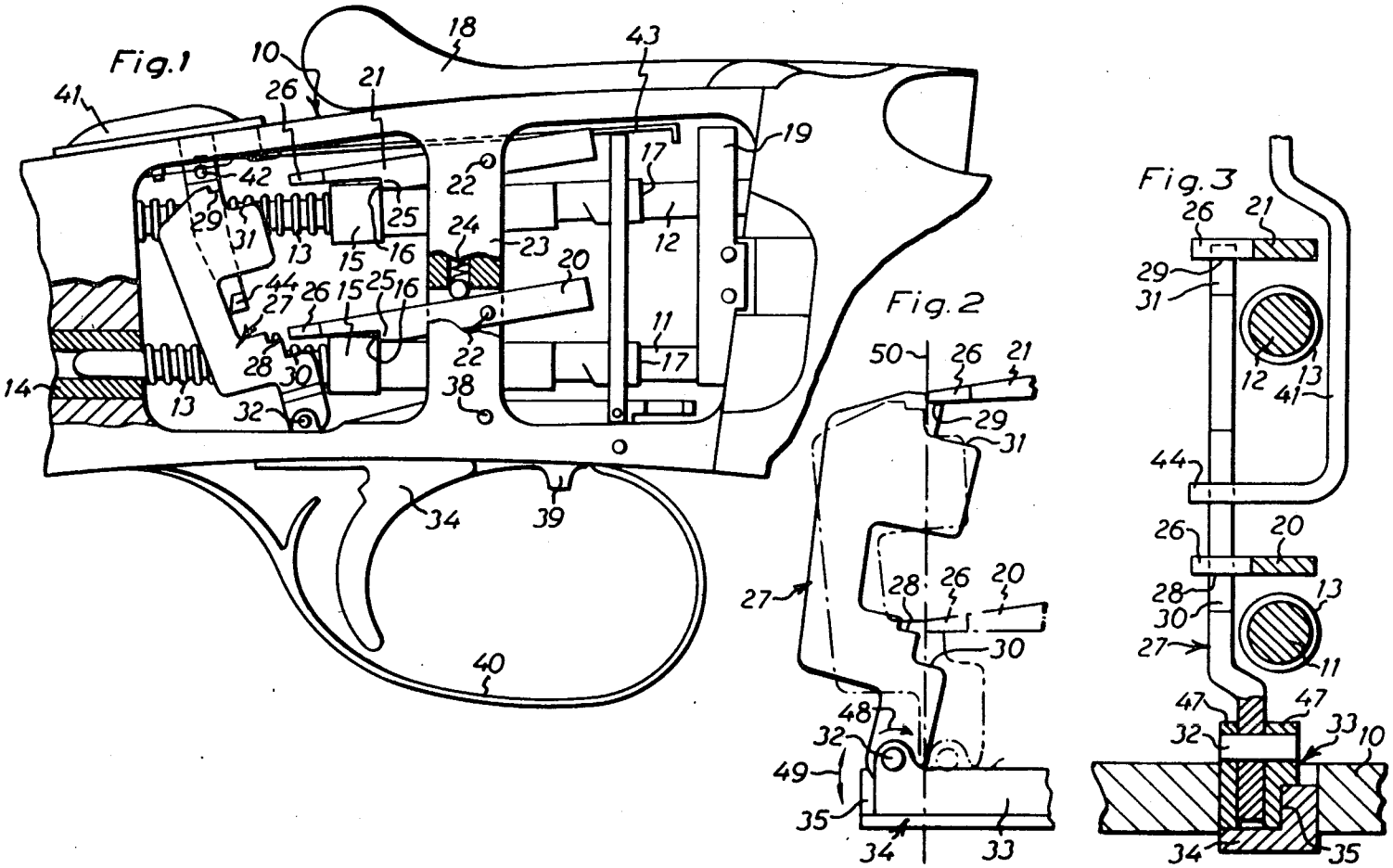
FIG. 1 is a side view in partial section showing the fire arm mechanism as locked in the cocked state.
FIG. 2 shows part of this mechanism in two positions of setting.
FIG. 3 is a section taken along the line III—III in FIG. 4.

As shown in FIG. 1, the fire arm mechanism has a casing 10 in which two firing pins 11, 12, are mounted for axial movement in a per se known manner. The firing pins are spring-loaded in the forward direction (to the right in FIG. 1) by means of compression springs 13. To permit mounting the firing pins, their rear ends are surrounded by a bearing bushing 14 inserted from the rear in a sufficiently large bore in the mechanism casing. Each firing pin has a thickened portion, on the upper side of which a cocking shoulder 16 is designed. The front end of the thickened portion forms an abutment surface 17. The mechanism, as is well known in the art, has a lever 18 which is rigidly connected to a cylindrical pin which is not shown in greater detail and extends through a downwardly directed bore in the mechanism casing. This pin, not illustrated in the drawing, has an eccentric which engages a firing pin cocking device with a cocking plate 19 through which the firing pins 11, 12 extend and which is pressed against the abutment surfaces 17 and will thus move the firing pins 11, 12 rearwardly when the cocking plate 19 is urged rearwardly by the eccentric upon pivotment of the lever 18.

The two firing pins 11, 12 are each arrestable in the cocked state by means of a respective release catch 20, 21. Each of these is mounted for pivoting about a pivot pin 22 in a partition wall 23 in the mechanism casing 10. The release catches 20, 21 are yieldingly biased in the downward direction by means of a respective compression spring 24 mounted in the partition and of which only one is shown. The release catches have each a cocking shoulder 25 by means of which the release catches engage the cocking shoulders 16 of the firing pins. The release catches also have an angular engagement portion 26 which is located in the path of movement of a firing push link 27 having pressure surfaces 28 and 29 and clearance recesses 30, 31. In the shown embodiment, the firing push link is designed as a sickle or a C and, at its lower end, is pivotally mounted on a pivot pin 32 which, as appears in particular from FIGS. 2 and 3, is disposed on a slide 33 which is mounted in a lateral groove 35 on the trigger 34. The slide is movable back and forth with respect to the trigger and can be set in two distinct positions which are determined by means of a snap catch device in the form of two transverse grooves or recesses 36 on the slide and, engaging therewith, a spring-biased roller 36' which is inserted in a hole in the trigger and whose spring 37 engages a surface on the partition 23. The trigger is mounted for pivoting about a pivot pin 38 fixedly mounted in the partition 23. The slide 33 has a control knob 39 which protrudes within the trigger guard 40 ahead of the gripping surface of the trigger.

In order to lock the mechanism when cocked there is a safety catch 41 which by means of a snap catch device 42 can be set in a locked, cocked position shown in FIG. 1, and in an unlocked, cocked position shown in FIGS. 4–11. The safety catch is in the form of a yoke and has an angular hook 44 which can be brought into engagement with the firing push link 27 to retract it to the locked position in FIG. 1. On pivoting the lever 18 and cocking the mechanism, the safety catch 41 is moved to its rear, locked position in that the cocking plate 19 rearwardly urges a push rod 43 engaging the safety catch. In the cocked, locked position, the pressure surfaces 28 and 29 of the firing push link cannot engage the engagement portions 26 of the release catches 20, 21 and so, pulling the trigger 34 will not produce firing of any barrel.

Figure 4:
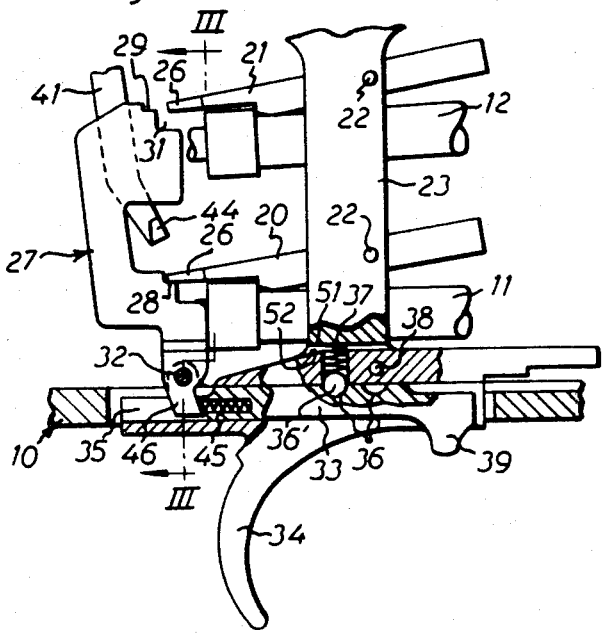
FIGS. 4–7 are views corresponding to that of FIG. 1 and show the different operational steps of the mechanism in the firing sequence under barrel - over barrel.

As appears from FIG. 4, the firing push link 27 mounted on the slide 33 is spring-loaded for pivoting clockwise with respect to FIG. 4. The spring bias is achieved by means of a compression spring 45 mounted in an axial hole in the slide 33, this compression spring acting on a lug 46 provided on the firing push link 27 and protruding underneath the pivot pin 32. This lug thus projects downwards between the two slide ears 47 forming bearings for the pivot pin 32.

As appears in particular from FIG. 2 and also from a comparison of FIGS. 4–7 with FIGS. 8–11, the slide 33 is displaceable between a rear position shown in full lines, and a front position shown in broken lines. As intimated by the arrow 48, the firing push link 27 is yieldingly urged in the clockwise direction and, as intimated by the double arrow 49, the trigger 34, the slide 33 and also the firing push link 27 are pivotal upwards and downwards about the pivot centre of the trigger defined by the pivot pin 38. In that both positions of setting are located on either side of a straight dash-dot connecting line 50 between the engagement portions 26 of the two release catches 20, 21, the firing order will become different in the two positions of setting. In the rear position shown in full lines, the upper pressure surface 29 thus engages the engagement portion 26 of the upper release catch 21, while the engagement portion 26 of the lower release catch 20 is situated opposite the clearance recess 30 of the firing push link. In the other position shown in broken lines, the lower pressure surface 28 engages the engagement portion 26 of the lower release catch 20, while the engagement portion 26 of the upper release catch 21 is situated opposite the clearance recess 31 of the firing push link.

Figure 5:
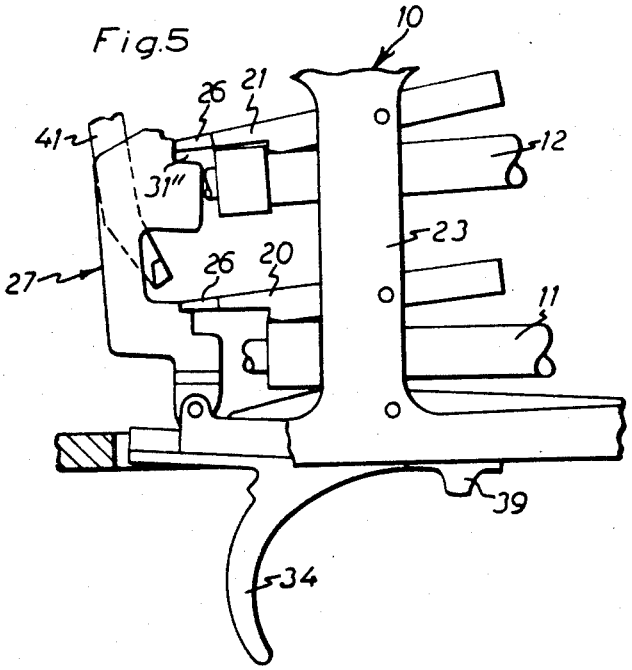

In FIGS. 4–7, the different positions of the mechanism are shown during firing of the two barrels when the firing sequence is under barrel first and over barrel last. In the unlocked starting position in which both firing pins 11, 12 are cocked, the lower pressure surface 28 of the firing push link 27 engages the engagement portion 26 of the lower release catch while the engagement portion 26 of the upper release catch 21 is situated opposite the clearance recess 31. In FIG. 5, the trigger 34 is pulled, the lower barrel having just been fired and the trigger pivoted clockwise to such an extent that an engagement between the surface 51 of the partition 23 and the upper side 52 of the trigger 34 has been brought about. This engagement thus defines the maximum pull of the trigger 34.

Figure 6:
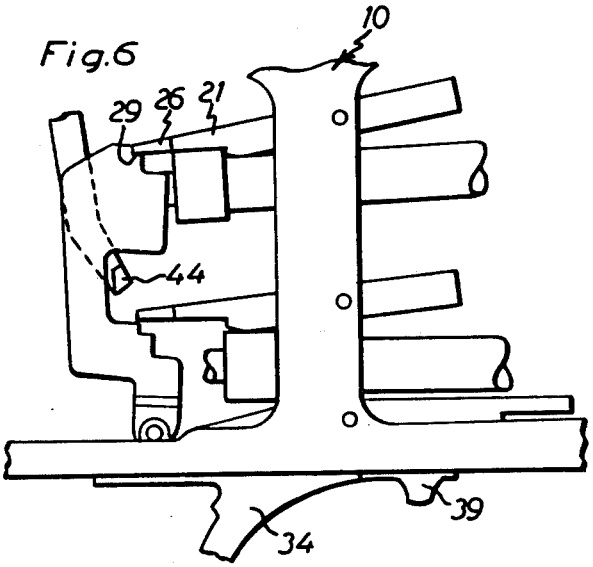

In FIG. 6, the mechanism is shown after the trigger 34 has been released and swung back to the initial position under the action of the compression spring 37. From FIG. 6 appears that the firing push link 27 during its downward movement from the position in FIG. 5 to the position in FIG. 6, has been caused to pivot in a forward direction under the action of the spring 45 such that the upper pressure surface 29 of the firing push link has now entered into engagement with the engagement portion 26 of the upper release catch 21, whereby the mechanism is now ready for firing of the upper barrel.

Figure 7:
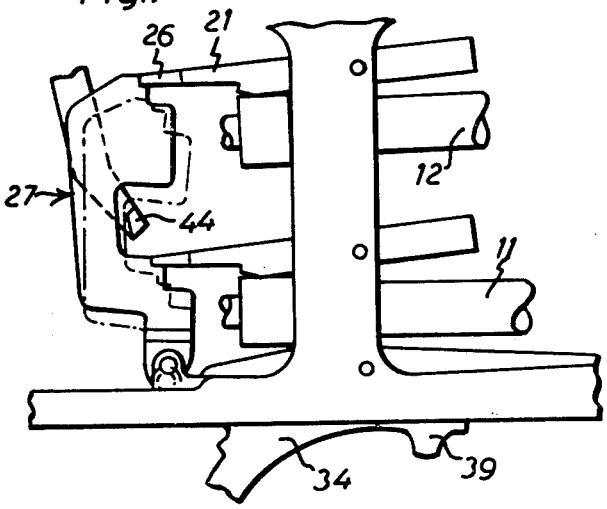
Figure 8:
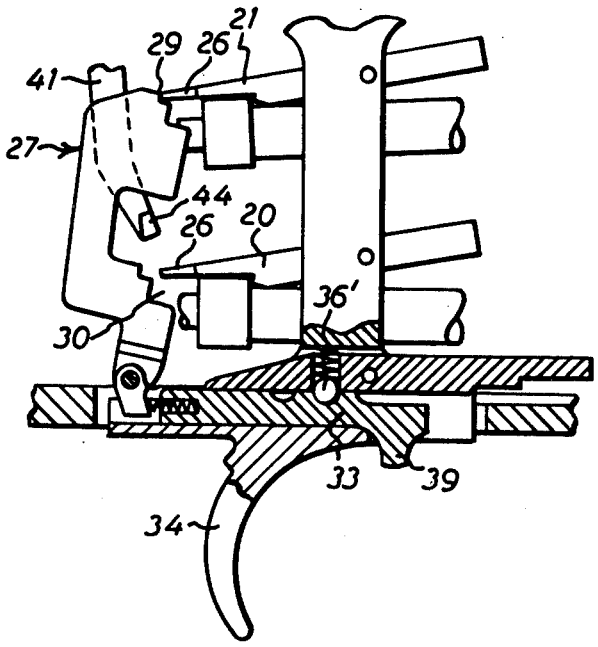

In FIG. 7, the full lines indicate the positions which the different parts of the mechanism occupy when the upper barrel has just been fired and the trigger is still being pulled. The dash-dot lines intimate the position of the firing push link 27 after both barrels have been fired and the trigger 34 has been released. The firing push link 27 now rests on the hook 44 of the safety catch.

Figure 9:
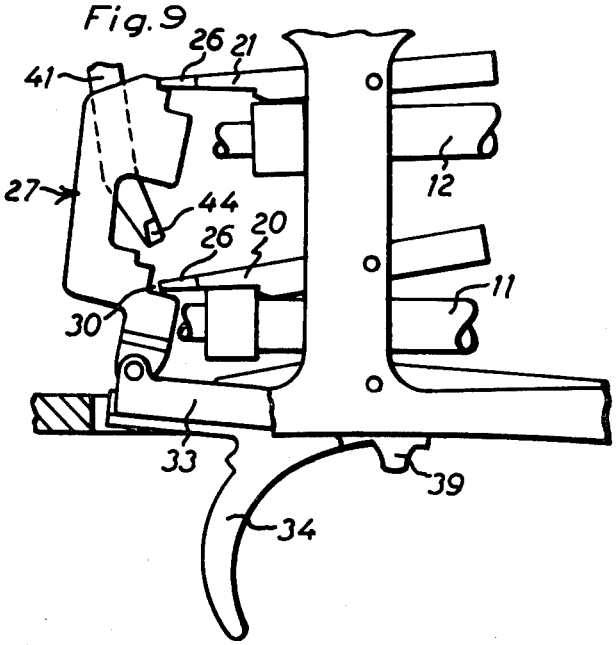
Figure 10:
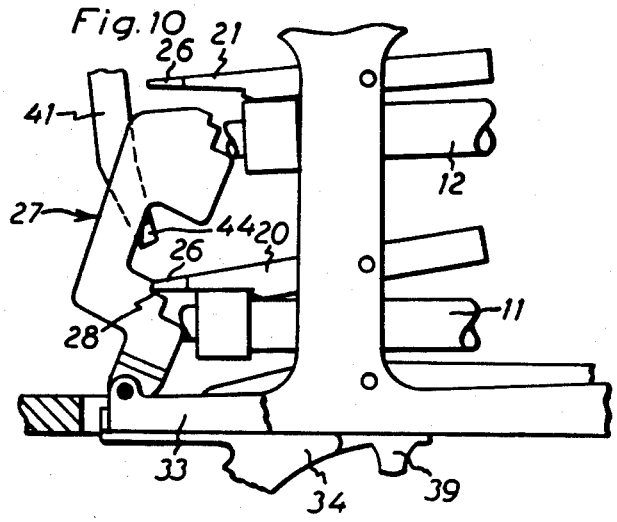
Figure 11:
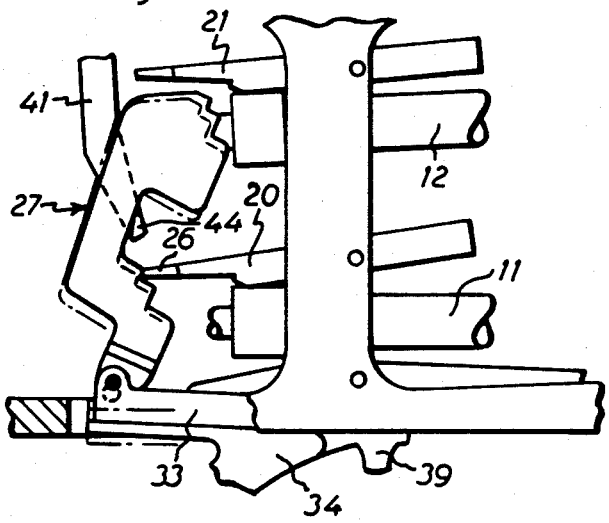

In FIGS. 8–11, the different positions of setting of the mechanism are shown when the firing sequence is over barrel first and under barrel last. As appears from FIG. 8, the slide 33 has now been retracted, so that the spring-biased roller 37 engages in the front recess 36 on the upper side of the slide 33. The upper pressure surface of the firing push link 27 then engages the engagement portion 26 of the upper release catch 21 while the engagement portion 26 of the lower release catch 20 is situated opposite the clearance recess 30, such that this engagement portion comes clear of the firing push link 27 when, as illustrated in FIG. 9, it is urged upwardly as the trigger 34 is pulled. When the trigger 34 is released after firing of the upper barrel, the firing push link 27 pivots clockwise under the action of the spring 45, such that the lower pressure surface 28 of the firing push link will enter into engagement with the engagement portion 26 of the lower release catch 20. When the trigger is pulled next time, the firing push link 27 will be raised to the position shown in full lines in FIG. 11 in which the lower firing pin 11 has also been released and fired. After the trigger 34 has been released, the firing push link will occupy the position shown in dash-dot lines in FIG. 11 in which the firing push link rests on the hook 44 of the safety catch.

When the mechanism is thereafter cocked by pivotment of the lever 18, both firing pins will be retracted to their positions shown in FIG. 1, in that the cocking plate 19 is retracted, thus moving the firing pins rearwardly by its engagement with the abutment surfaces 17 on the thickened portions of the firing pins. At the same time, the safety catch 41 will be urged rearwardly, this rearward movement being transmitted from the lever 18 through the cocking plate 19 and the push rod 43. The mechanism is then ready to be fired again in an optional sequence.

The embodiment of the invention described above is merely an example of possible embodiments within the scope of the invention. Thus, the invention is also applicable to, for instance, three barrels, in which case use is made of a corresponding number of release catches with engagement portions and a corresponding number of pressure surfaces and clearance recesses are designed on the firing push link. In this instance, the firing sequence can be shifted between the firing order 1, 2, 3 and the firing order 3, 2, 1.

In the illustrated embodiment, the firing means of the mechanism consist of spring-loaded firing pins which are held arrested by means of release catches. The same type of selector mechanism is however usable if the firing means consist of internal hammers which are maintained in the cocked state by means of the engagement portions 26 of the release catches and which when released impinge on separate displaceably mounted firing pins transmitting the force of impact to the cartridges.

We claim:

1. A fire arm mechanism for a weapon having a plurality of barrels, wherein said mechanism is adjustable for selection of the firing sequence for the barrels of the weapon, the weapon having firing means for the barrels, and pivotally mounted release catches and a firing push link, the firing means having a cocked state established by and associated with said pivotally mounted release catches, and each of said release catches having an engagement surface for interacting with said firing push link, said push link having a plurality of pressure surfaces; and a pivotally mounted trigger for the mechanism, the said firing means of the barrels being arrestable in said cocked state by means of said associated pivotally mounted release catches with an engagement surface engaging a respective corresponding pressure surface on said firing push link, said push link being pivotal about a pivot axis and thereby pivotally connected to said pivotally mounted trigger, said trigger being common to the different firing means and yieldingly biased for pivoting in a direction for engaging the different release catches for successively releasing their associated firing means upon consecutive pulls of the trigger, characterised in that the pivot axis of the firing push link is displaceable between two positions which are located on either side of a straight line between the engagement surfaces of the release catches for setting the firing push link and its pressure surfaces in different angular positions with respect to said engagement surfaces in order to determine the firing sequence.

2. Mechanism as claimed in claim 1, characterised in that the firing push link is pivotally connected to a slide which is so displaceably mounted on the trigger that the distance between the pivot axes of the trigger and of the firing push link pivotally connected thereto is adjustable for selection of the firing sequence.

3. Mechanism as claimed in claim 2 wherein a trigger guard is mounted ahead of the trigger, characterised in that the slide has a control knob projecting within the trigger guard of the weapon ahead of the trigger.

4. Mechanism as claimed in claim 2, characterised in that a snap catch device is provided between the trigger and the slide for releasably locking the slide in distinct positions of setting.

5. Mechanism as claimed in claim 4, characterised in that the mechanism has a safety catch which is movable to engagement with the firing push link in order, for locking the weapon in the cocked state, to pivot the firing push link to a locked position in which the pressure surfaces of the firing push link are prevented from entering into engagement with the engagement surfaces of the different release catches.

6. Mechanism as claimed in claim 3, characterised in that a snap catch device is provided between the trigger and the slide for releasably locking the slide in distinct positions of setting.

* * * * *